United States Patent [19]

Ohkubo et al.

[11] Patent Number: 4,850,195

[45] Date of Patent: Jul. 25, 1989

[54] FUEL SPRAY COMBUSTION DEVICE

[75] Inventors: Yoichiro Ohkubo; Yoshinori Idota; Yasusi Tanasawa, all of Aichi, Japan

[73] Assignee: Kabushiki Kaisha Toyota Chuo Kenkyusho, Aichi, Japan

[21] Appl. No.: 913,378

[22] Filed: Sep. 30, 1986

[30] Foreign Application Priority Data

| | | | |
|---|---|---|---|
| Sep. 30, 1985 | [JP] | Japan | 60-217549 |
| Mar. 6, 1986 | [JP] | Japan | 61-49469 |
| Apr. 17, 1986 | [JP] | Japan | 61-89103 |

[51] Int. Cl.[4] ..... F02C 1/00

[52] U.S. Cl. ..... 60/738; 60/748; 60/732

[58] Field of Search ..... 60/748, 732, 733, 738, 60/737, 736

[56] References Cited

U.S. PATENT DOCUMENTS

| | | | |
|---|---|---|---|
| 3,648,457 | 3/1972 | Bobo | 60/748 |
| 3,946,552 | 3/1976 | Weinstein et al. | 60/748 |
| 3,972,182 | 8/1976 | Salvi | 60/748 |
| 3,982,392 | 9/1976 | Crow | 60/748 |
| 4,006,589 | 2/1977 | Schirmer | 60/748 |
| 4,041,699 | 8/1977 | Schelp | 60/732 |
| 4,420,929 | 12/1983 | Jorgensen et al. | 60/733 |

FOREIGN PATENT DOCUMENTS

| | | | |
|---|---|---|---|
| 2116308 | 9/1983 | United Kingdom | 60/732 |

*Primary Examiner*—Donald E. Stout

*Attorney, Agent, or Firm*—Oblon, Spivak, McClelland, Maier & Neustadt

[57] ABSTRACT

A domestic or industrial fuel spray combustion device which includes a cylinder-shaped swirl chamber into which air streams are introduced; a fuel injection atomizer for spraying fuel to the swirl chamber; an ignition plug; a first combustion cylinder connected through a choke to the swirl chamber, the first combustion cylinder being coaxial with the swirl chamber; and being larger than an equal to the swirl chamber in diameter and a second combustion cylinder connected through a choke to the first combustion cylinder, the second combustion cylinder being coaxial with the first combustion chamber and being equal to or smaller than the first combustion cylinder in diameter. This structure provides a compact combustion device which enables stable combustion even with a small amount of fuel.

15 Claims, 8 Drawing Sheets

FUEL SPRAY COMBUSTION DEVICE

BACKGROUND OF THE INVENTION

2. Field of the Invention

This invention relates to domestic or industrial fuel spray combustion devices, and more particularly to a small fuel spray combustion engine for vehicles.

2. Description of the Prior Art

In a conventional fuel spray combustion device, as disclosed by Japanese Laid-Open Patent publication No. 147921/1984, a swirl chamber is provided at the center of a swirling air stream forming unit, a fuel jet nozzle for spraying fuel from the closed end of the swirl chamber towards the open end is connected to the swirl chamber in such a manner that it is coaxial with the swirl chamber, a first combustion cylinder is connected to the open end of the swirl chamber, a second combustion cylinder is connected through a first choke to the outlet of the first combustion cylinder in such a manner that it is coaxial with the first combustion cylinder, the second combustion cylinder being larger in diameter than the first combustion cylinder, and a second choke is provided at the outlet of the second combustion cylinder.

As is apparent from the above description, in the conventional combustion device, the second combustion cylinder is larger in diameter than the first combustion cylinder; that is, the combustion cylinder assembly is of an expanded tube type that a tube is expanded at the end. Therefore, the body of the combustion device, comprising the first and second combustion cylinders, is relatively large in diameter. Therefore, a car heater formed by putting a heat exchanger on the body is relatively bulky. In other words, it is difficult to provide a small car heater by using the conventional combustion device.

As the combustion cylinder assembly is of the above-described expanded tube type, the combustion flame is also expanded towards the end, and especially it becomes unstable in the small fuel flow region. Therefore, sometimes fuel is not satisfactorily burnt, i.e., the range of combustion is small.

SUMMARY OF THE INVENTION

Accordingly, an object of this invention is to provide a fuel spray combustion device in which the above-described difficulties accompanying a conventional fuel spray combustion device have been eliminated.

In the conventional combustion device, the mixture gas stream or the combustion flame is expanded at the end of the combustion cylinder assembly in order to accelerate the mixing of the fuel in the mixture gas stream and the air. On the other hand, the present inventors have found that if the mixture gas stream or the combustion flame is contracted at the end of the combustion cylinder assembly (thereby to raise the temperature there and increase the velocity of the mixture gas stream), mixing of the fuel and the air is promoted and also the complete fuel combustion is attained.

The foregoing object of the invention has been achieved by the provision of a fuel spray combustion device which, according to the invention, comprises: a cylinder-shaped swirl chamber into which air streams are introduced to swirl around the central axis of the swirl chamber; fuel injection means for spraying fuel from one end of the swirl chamber towards the other end, the fuel injection means being coupled to the swirl chamber in such a manner that it is coaxial with the swirl chamber; an ignition plug provided in such a manner that its ignition end is in the fuel atomizing region of the fuel injection means; a first combustion cylinder connected through a choke to the other end of the swirl chamber in such a manner that it is coaxial with the swirl chamber, has uninterrupted circumferential walls and is larger than or equal to the swirl chamber in diameter; and a second combustion cylinder connected through a choke to the outlet of the first combustion cylinder in such a manner that the first and second combustion cylinder are coaxial with each other, the second combustion cylinder being smaller than or equal to the first combustion cylinder in diameter.

In the fuel spray combustion device of the invention, the second combustion cylinder is smaller than or equal to the first combustion cylinder in diameter, and therefore the body is not bulky. Accordingly, a car heater formed by putting a heat exchanger on the body is not bulky. That is, a small car heater can be readily provided by utilizing the fuel spray combustion device of the invention.

In the case where the second combustion cylinder is smaller in diameter than the first combustion cylinder, the combustion flame, being tapered towards the end, is high in stability. Accordingly, even if the flow rate of fuel is changed, only the length of the combustion flame is changed; that is, the combustion flame is maintained stable, and unsatisfactory combustion attributing to the flickering of the combustion flame will not be caused. Since the combustion flame is stable as was described above, even if no choke is provided at the outlet of the second combustion cylinder, the combustion gas scarcely flows back into the second combustion cylinder, and accordingly unsatisfactory combustion attributing to the reverse flow of combustion gas is scarcely caused.

In the case where the second combustion cylinder is equal in diameter to the first combustion cylinder, effects substantially the same as those provided in the above-described case can be obtained when the mixture gas is larger in flow rate than that in the above-described case.

The nature, principle and utility of the invention will become more apparent from the following detailed description and the appended claims when read in conjunction with the accompanying drawings.

BRIEF DESCRIPTION OF THE DRAWINGS

In the accompanying drawings

DESCRIPTION OF THE PREFERRED EMBODIMENTS

Preferred embodiments of this invention will be described with reference to the accompanying drawings.

First Embodiment (cf. FIGS. 1 through 7)

Figure 1:
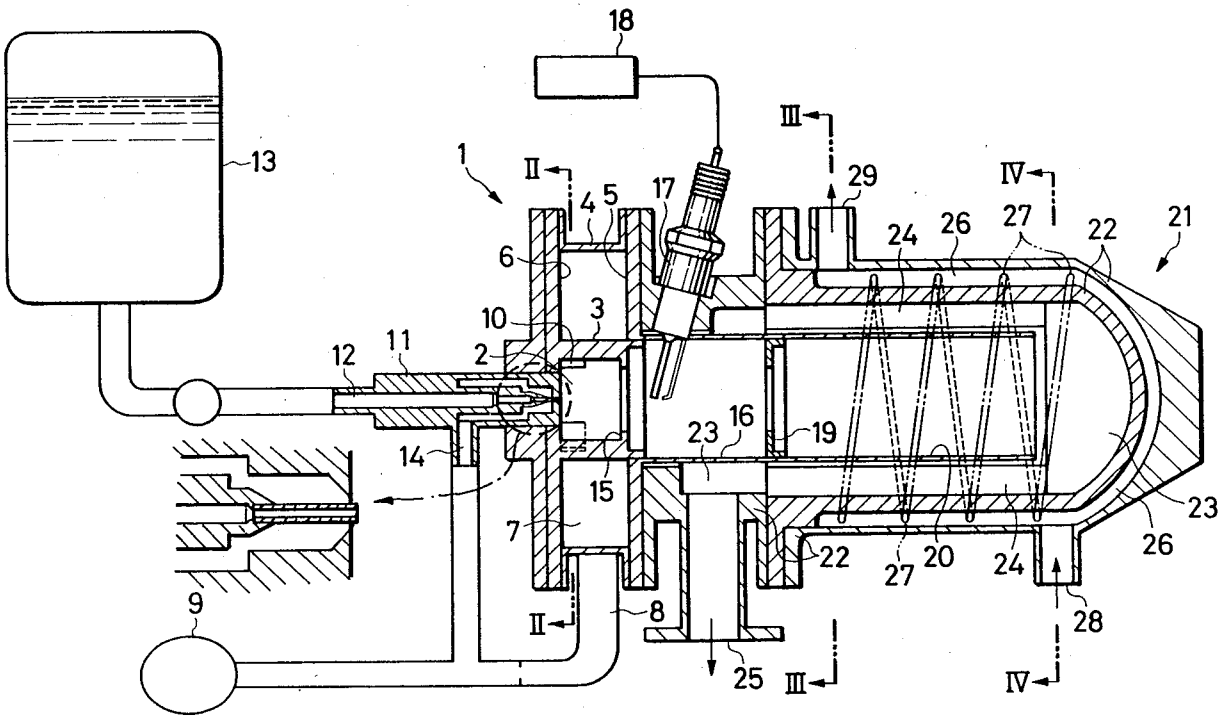
FIG. 1 is a longitudinal sectional side view of a fuel spray combustion device, a first embodiment of this invention.

In a fuel spray combustion device, a first embodiment of the invention, as shown in FIG. 1, a cylinder-shaped swirl chamber 2 is formed in the central portion of a swirling air flow forming unit 1, namely, a swirl unit 1, a fuel injection nozzle 11 for spraying fuel towards the open end of the swirl chamber 2 from the closed end is installed on the swirl chamber 2 in such a manner that the fuel injection nozzle 11 is coaxial with the swirl chamber 2, a first combustion cylinder 16 is connected through a first choke 15 to the open end of the swirl chamber 2 in such a manner that the first combustion cylinder 16 is coaxial with the swirl chamber 2, an ignition plug 17 is installed on the first combustion cylinder 16 in such a manner that its end portion, namely, the ignition part of the ignition plug is on the central axis of the first combustion cylinder 16, and a second combustion cylinder 20 is connected through a second choke 19 to the outlet of the first combustion cylinder 16 in such a manner that the second combustion cylinder 20 is coaxial with the first combustion cylinder 16.

The first combustion cylinder 16 is larger in diameter than the swirl chamber 2. The second combustion cylinder 20 is equal in diameter to the first combustion cylinder 16. No choke is provided at the outlet of the second combustion cylinder 20.

Figure 2:
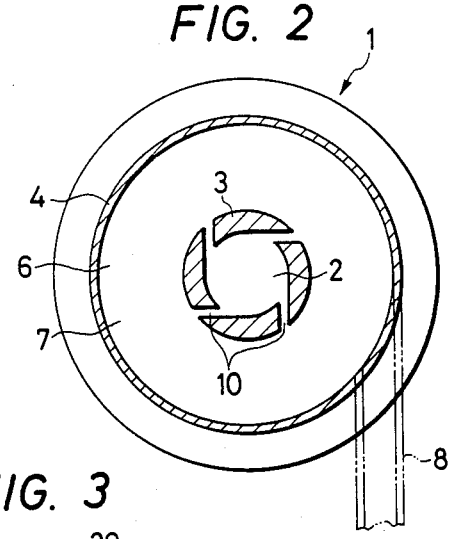
FIG. 2 is a sectional view taken along line II—II in FIG. 1.

In the swirl unit 1, as shown in FIGS. 1 and 2, the swirl chamber 2 has a cylinder-shaped inner circumferential wall 3, and a cylinder-shaped outer circumferential wall 4 is provided outside the inner circumferential wall 3 in such a manner that the former 4 is coaxial with the latter 3. Further in the swirl unit 1, an annular air swirling path 7 is formed by connecting a front end plate 5 and a rear end plate 6 respectively to the front ends and the rear ends of the inner and outer circumferential walls 3 and 4. An air intake pipe 8 is connected to the outer circumferential wall 4 at one point in such a manner that the pipe 8 is extended along the line tangent to the point and communicated with the air swirling path 7. The air intake pipe 8 is connected to an air supplying source 9. Four air intake holes 10 are formed in the inner circumferential wall 3 at four points in such a manner that the holes 10 are extended along the lines tangent to the four points, respectively, and the air swirling path 7 is communicated through the holes to the swirl chamber 2; that is, air flows are introduced into the swirl chamber 2 which swirl around the central axis of the swirl chamber 2.

The fuel injection nozzle 11, as shown in FIG. 1, has its fuel injection end portion inserted into the rear end plate 6 in such a manner that it is coaxial with the swirl chamber 2. The fuel injection nozzle 11 is a twin fluid atomization type fuel injection nozzle which atomizes liquid fuel from a fuel supplying path 12 with an air flow from an air supplying path 14. The fuel supplying path 12 . is connected to a fuel supplying source 13, and the air supplying path 14 is connected to the air supplying source 9.

The ignition plug 17 has its ignition part disposed in the fuel spraying region of the fuel injection nozzle 11, and has a terminal at the base which is connected to an ignition power source 18.

In the above-described fuel spray combustion device of the invention, a heat exchanger 21 is put on the combustion cylinders 16 and 20, to form a car heater.

Figure 3:
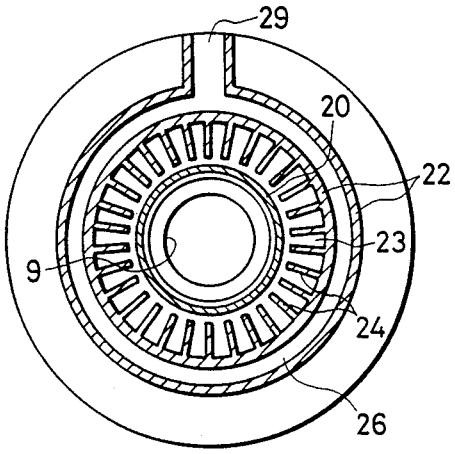
FIG. 3 is a sectional view taken along line III—III in FIG. 1.
Figure 4:
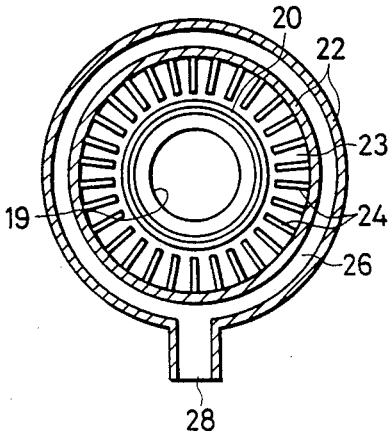
FIG. 4 is a sectional view taken along line IV—IV in FIG. 1.

The heat exchanger 21 is designed as shown in FIGS. 1, 3 and 4. A cylindrical container 22 is put on the first combustion cylinder 16 and the second combustion cylinder 20 in such a manner that a gas passage 23 communicated with the outlet of the second combustion cylinder 20 is formed between the container 22 and the first and second combustion cylinders 16 and 20. A number of heat exchanging fins 24 are formed at equal intervals on the inner circumferential surface of the container 22, in such a manner that the fins 24 are provided around the second combustion cylinder 20 and extended towards the central axis of the cylinder 20. The outlet 25 of the gas passage 23 is formed in the portion of the container 22 which is on the side of the first combustion cylinder 16. On the other hand, the portion of the container 22 which is on the side of the second combustion cylinder 20 is formed into a dual-container which has a fluid passage 26 in it. A heat exchanging spiral fin 27 is provided on the inner circumferential wall of the fluid passage 26. The fluid passage 26 has an inlet 28 and an outlet 29 as shown in FIG. 1. The inlet 28 of the fluid passage is connected to a fluid supplying source, and the outlet 29 is connected to a radiator.

The above-described fuel spray combustion device operates as follows: First, air streams are introduced into the swirl chamber 2, thus swirling around the central axis of the swirl chamber 2, while fuel such as diesel oil, kerosene or gasoline is sprayed from the fuel injection nozzle 11 to the center of the swirling air streams in the swirl chamber 2. As a result, the gas stream which is the mixture of the sprayed fuel and the swirling air streams flows from the swirl chamber 2 through the first choke 15 into the first combustion cylinder 16 having uninterrupted circumferential walls, where it is ignited by the ignition plug 17, thus being burnt. The resultant combustion flame goes from the first combustion cylinder 16 through the second choke 19 into the second combustion cylinder 20, and the combustion gas formed by the combustion flows from the second combustion cylinder 20 into the gas passage 23 to heat the heat exchanging fins 24 and the cylindrical container 22, and finally the combustion gas is discharged through outlet 25. On the other hand, fluid such as water or air supplied to the inlet 28 of the fluid passage flows into the fluid passage 26. Therefore, the fluid is heated by the heat exchanging fin 27 in the fluid passage and the cylindrical container 22, so that the temperature of the fluid is increased before the fluid is discharged through the outlet 29.

In the above-described fuel spray combustion device, the first choke 15 is provided between the swirl chamber 2 and the first combustion cylinder 16, and the first combustion cylinder 16 is larger in diameter than the swirl chamber 2. Therefore, when the combustion flame of the mixture gas flows from the swirl chamber 2 through the first choke 15 into the first combustion cylinder 16, it is abruptly expanded, thus spreading to the circumferential wall of the first combustion cylinder 16, i.e., the combustion flame is distributed uniformly in the entire first combustion cylinder 16. Thus, the fuel spray combustion device of the invention can perform high load combustion.

The abrupt expansion of the combustion flame forms a stable circulation region in the first combustion cylinder 16, as a result of which the flame is maintained satisfactory. Accordingly, even with a load about one-third of the maximum load, the flame is held stable.

If, in the case where the first combustion cylinder 16 is equal in diameter to the swirl chamber 2, the diameter of the first choke 15 is set to a suitable value when the mixture gas is larger in flow rate than that provided in the above-described case where the first combustion cylinder 16 is larger in diameter than the swirl chamber 2, substantially the same effect can be obtained.

Figure 5:
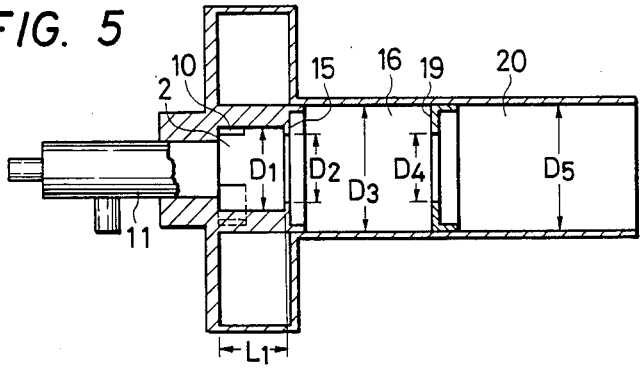
FIG. 5 is a longitudinal sectional side view showing a part of the combustion device shown in FIG. 1.

The fuel spray combustion device of the invention essentially comprises the fuel injection nozzle, the swirl chamber, the first choke, the first combustion cylinder, the second choke, and the second combustion cylinder as was described above. It is preferable that the ratios of the dimensions of these components are defined as follows: In the following expressions, as shown in FIG. 5, $D_1$: the diameter of the swirl chamber 2

$D_2$: the diameter of the first choke 15

$D_3$: the diameter of the first combustion cylinder 16

$D_4$: the diameter of the second choke 19

$D_5$: the diameter of the second combustion cylinder 20

$L_1$: the length of the swirl chamber 2

(1) $0.6 \leqq D_2/D_1 \leqq 1$

In the case of $D_2/D_1 \leqq 0.6$, the sprayed fuel flows down the first choke 15, or the combustion flame is not satisfactorily maintained.

(2) $0.5 \leqq D_4/D_3 \leqq 0.8$

In the case of $D_4/D_3 < 0.5$, the passage resistance from the first combustion cylinder 16 to the second combustion cylinder 20 is increased, and therefore the combustion flame cannot smoothly flow. In the case of $D_4/D_3 > 0.8$, the effect of the second choke 19 is less.

(3) $0.6 \leqq D_5/D_3 \leqq 1$

With $D_5/D_3 < 0.6$, the combustion flame comes excessively close to the circumferential wall of the second combustion cylinder 20, and the passage resistance of the second combustion cylinder 20 is increased, with the result that the combustion is unsatisfactory.

(4) $1 \leqq D_3/D_1 \leqq 2$

In the case of $D_3/D_1 > 2$, the combustion flame is not sufficiently spread in the first combustion cylinder 16, or the combustion flame cannot cover the entire space in the first combustion cylinder 16. Accordingly, in this case, it is difficult to miniaturized the combustion device.

(5) $0.5 \leqq L_1/D_1 \leqq 1.5$

In the case of $L_1/D_1 < 0.5$, the distance required for mixing the swirling air streams and the sprayed fuel in the swirl chamber 2 is insufficient, and therefore the combustion is unsatisfactory. In the case of $L_1/D_1 > 1.5$, the sprayed fuel sticks to the circumferential wall of the swirl chamber 2, and the amount of discharge of hydrocarbon not burnt is increased.

(6) If the sum of the sectional areas of the air intake holes 10 in the swirl chamber 2 is represented by $S_0$, and the area of the circumferential wall of the swirl chamber 2 is represented by $S_1 = \pi \cdot D_1 \cdot L_1$, then $$2 \leqq S_1/S_0 \leqq 100$$

In the case of $S_1/S_0 > 100$, it is necessary to provide a high-pressure generating means in order to introduce swirling air streams into the swirl chamber 2. Accordingly, the combustion device is necessarily equally. This is not suitable for miniaturization of the combustion device. Further, the velocity of the swirling air streams becomes too high, which prevents the mixing of the swirling air streams and the sprayed fuel. In the case of $S_1/S_0 < 2$, the velocity of the swirling air streams is inadequate.

(7) If the fuel injection nozzle 11 is protruded as long as into the swirl chamber 2, then $$0 \leqq l \leqq L_1/2$$

In the case where the fuel injection nozzle 11 is of a twin fluid atomization type that fluid fuel is atomized by an air stream, the injection speed is high, and therefore the swirl chamber 2 should have a distance not less than $L_1/2$ in order to sufficiently mix the sprayed fuel and the swirling air streams.

The performance of the fuel spray combustion device of the invention will be described in which $D_2/D_1 = 1$, $D_3/D_1 = 1.5$, $D_4/D_3 = 0.56$, $D_5/D_3 = 1$, $L_1/D_1 = 1$, $S_1/S_0 = 47$, and $l = 0$.

Figure 6:
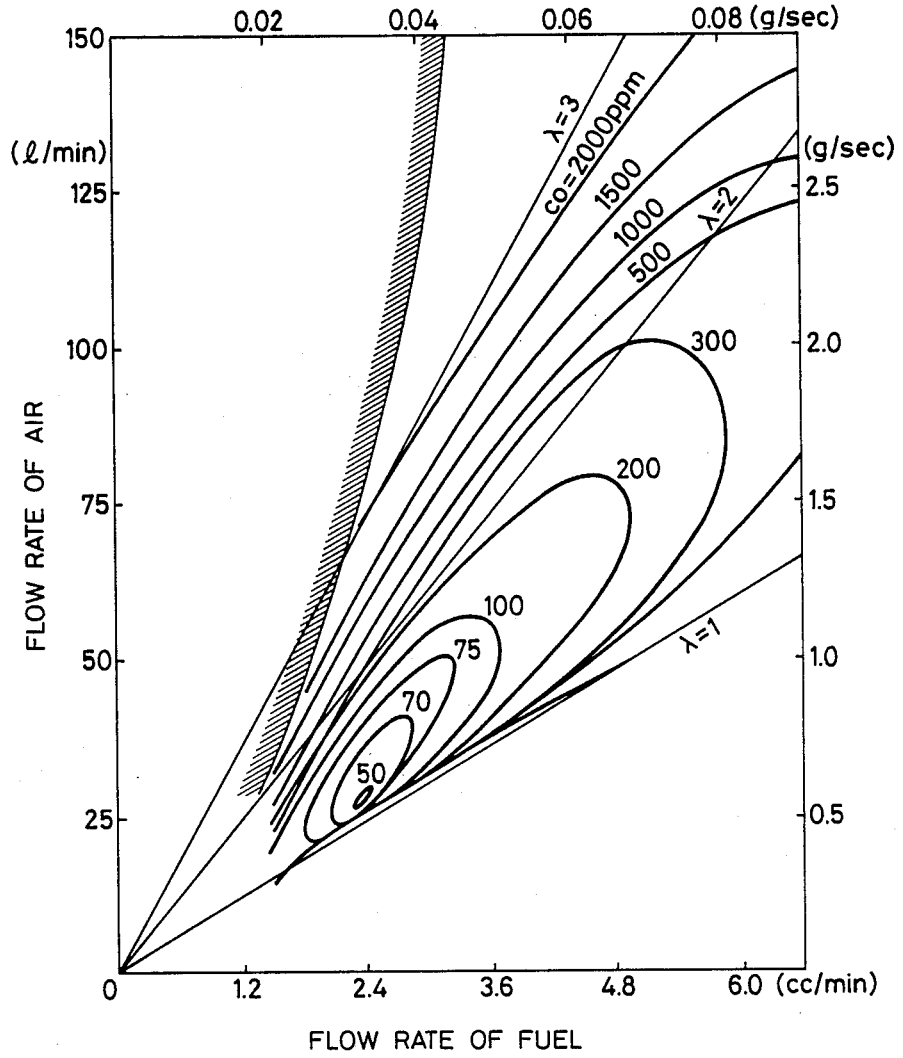
FIGS. 6 and 7 are graphical representations for a description of the performance of the combustion device shown in FIG. 1.
Figure 7:
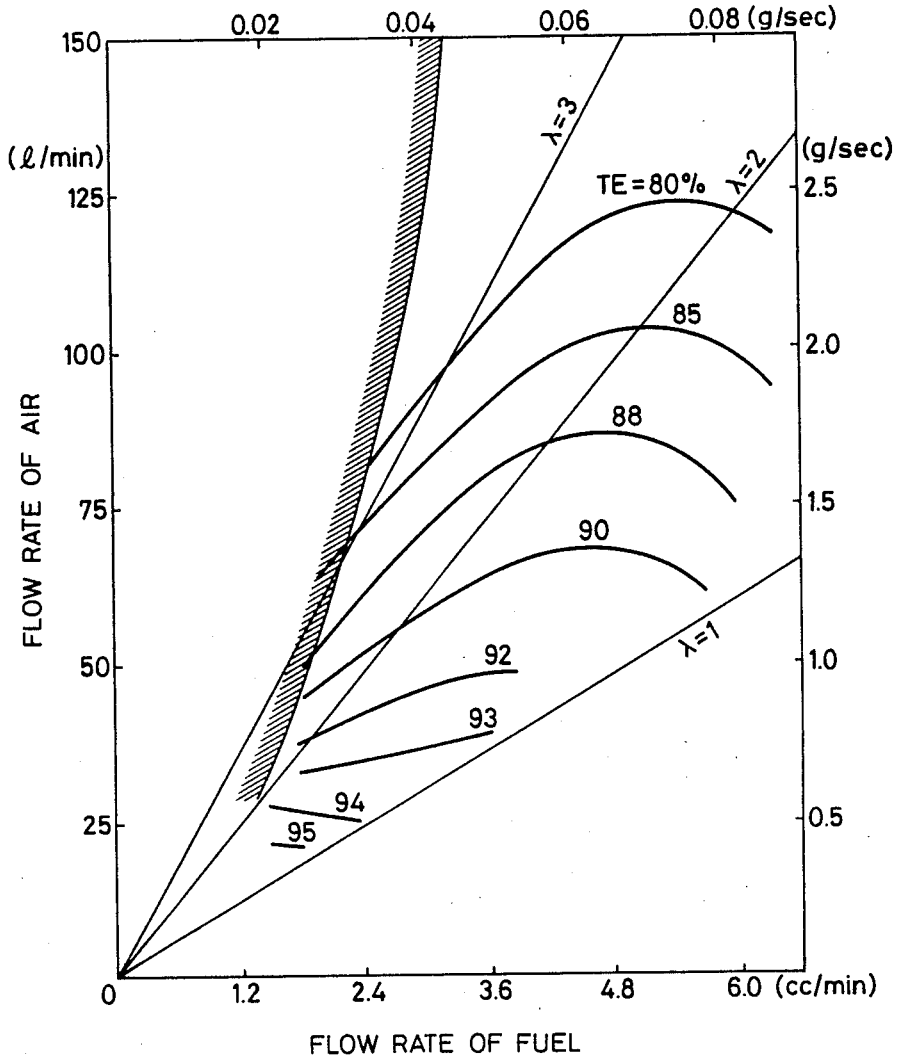

In each of the graphical representations of FIGS. 6 and 7, the vertical axis is the flow rate of air supplied to the air intake path 8 of the swirl unit and the air supplying path 14 of the fuel injection nozzle, and the horizontal axis is the flow rate of fuel such as diesel oil supplied to the fuel supplying path 12 of the fuel injection nozzle. In FIGS. 6 and 7, reference character $\lambda$ designates an air excess ratio, i.e., a ratio of a flow rate of air supplied to a theoretical flow rate of air necessary for combustion. The left side of the vertical line which has hatching and intersects the line of $\lambda = 3$ is the region in which the combustion flame is unstable.

In FIG. 6, reference character CO designates the concentration of carbon monoxide in the combustion gas discharged through the outlet 25 of the gas passage. As is apparent from FIG. 6, the concentration of carbon monoxide in the combustion gas is considerably small, not more than about 300 ppm with $1.1 \leqq \lambda \leqq 2.2$.

In FIG. 7, reference character TE designates the thermal efficiency of a car heater, i.e., the percentage of the quantity of heat received by the water passing through the fluid passage 26 with respect to the calorific value given by the supplied fuel. As is apparent from FIG. 7, the car heater's thermal efficiency is considerably high, 85% to 95%.

The fuel supplied at a small flow rate of 1.2 to 6 cc/min is satisfactorily burnt. That is, the range of combustion corresponds to a small part of the flow rate of fuel and is wide. The calorific value thus given is in a range of 600 to 3000 Kcal/h.

Second Embodiment (cf. FIGS. 8 through 11)

Figure 8:
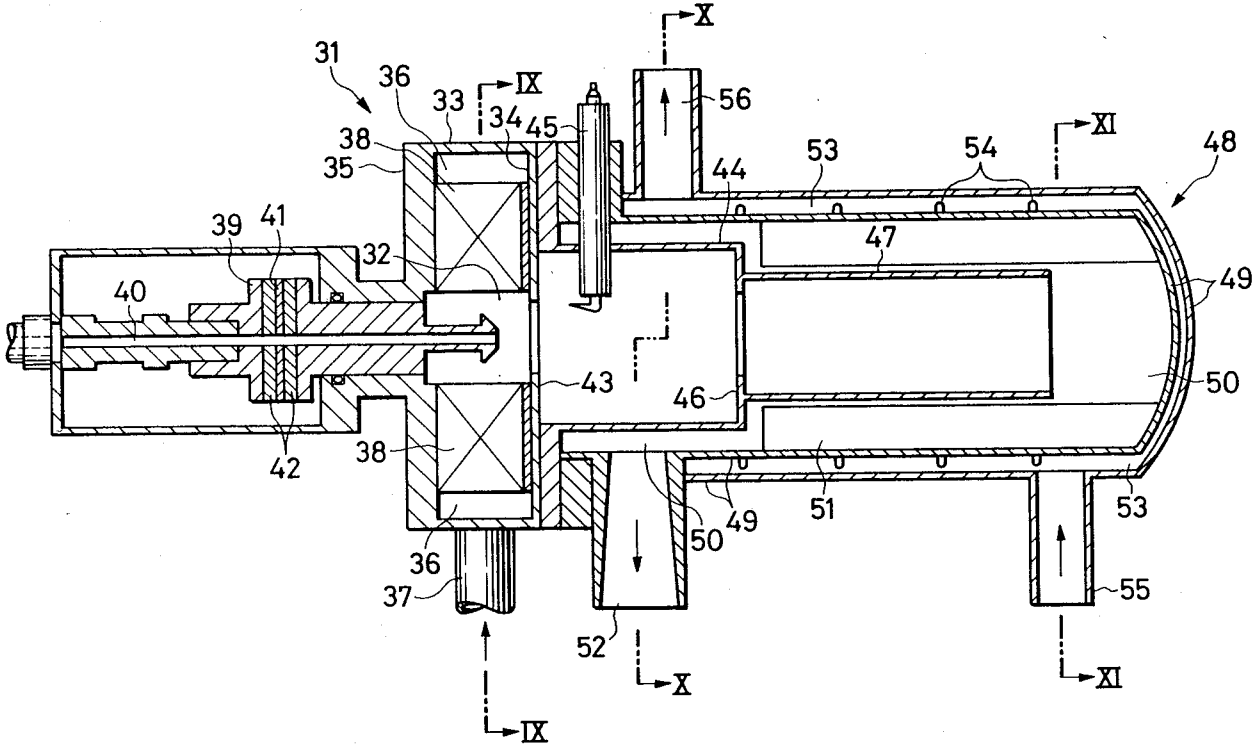
FIG. 8 is a longitudinal sectional side view of a fuel spray combustion device, a second embodiment of the invention.

A fuel spray combustion device, a second embodiment of the invention, as shown in FIG. 8 comprises: a swirling air stream forming unit, namely, a swirl unit 31; and a cylinder-shaped swirl chamber 32 formed in the central portion of the swirl unit. A fuel injection nozzle 39 for spraying fuel from the closed end of the swirl chamber 32 towards the open end is installed on the swirl chamber in such a manner that the fuel injection nozzle 39 is coaxial with the swirl chamber. The open end of the swirl chamber 32 is connected through a first choke 43 to a first combustion cylinder 44 in such a manner that the first combustion cylinder is coaxial with the swirl chamber. An ignition plug 45 is installed on the first combustion cylinder 44 in such a manner that its end portion, namely, the ignition part of the ignition plug 45 is protruded inside the first combustion cylinder. The outlet of the first combustion cylinder 44 is connected through a second choke 46 to a second combustion cylinder 47 in such a manner that the second combustion cylinder 47 is coaxial with the first combustion cylinder 44.

The first combustion cylinder 44 is larger in diameter than the swirl chamber 32. The second combustion cylinder 47 is smaller in diameter than the first combustion cylinder 44.

Figure 9:
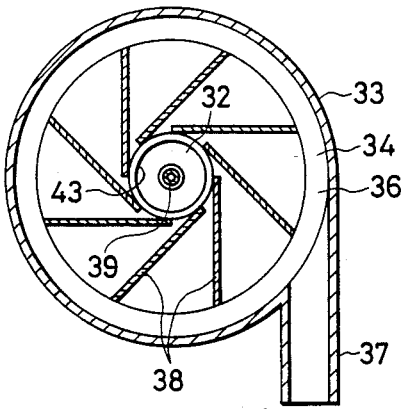
FIG. 9 is a sectional view taken along line IX—IX in FIG. 8.

In the swirl unit 31, as shown in FIGS. 8 and 9, an outer circumferential wall 33 in the form of a cylinder is arranged outside the swirl chamber 32, and a front end plate 34 and a rear end plate 35 are connected respectively to the front and rear ends of the circumferential wall 33 to form an annular air swirling path 36. An air intake tube 37 is connected to the outer circumferential wall 33 at one point in such a manner that the tube 37 is extended along the line tangent to the point and communicated with the air swirling path 36. A number of guide blades 38 are provided in the air swirling path 36 in such a manner that the guide blades 38 are arranged around the swirl chamber 32 and extended radially, i.e., along the lines tangent to the guide blade connecting points on the circumferential surface of the swirl chamber 32. The air swirling path 36 is communicated with the swirl chamber 32 through the gaps formed between the guide blades 38 so that air streams are introduced into the swirl chamber 32 and swirled around the central axis of the swirl chamber.

The fuel injection nozzle 39 is installed on the rear end plate 35 of the swirl chamber in such a manner that its injection end portion is protruded into the swirl chamber 32 more than half of the length of the swirl chamber and the fuel injection nozzle is coaxial with the swirl chamber. The fuel injection nozzle 39 is of ultrasonic oscillation type that liquid fuel supplied through a fuel supplying path 40 is atomized by the an ultrasonic oscillation which is caused by two electrostrictive elements 42 holding an electrode 41 therebetween.

The ignition plug 45 has its end part, namely, an ignition part arranged in the fuel spraying region of the fuel injection nozzle 39.

In the above-described fuel spray combustion device of the invention, a heat exchanger 48 is put on the combustion cylinders 44 and 47 to form a car heater.

Figure 10:
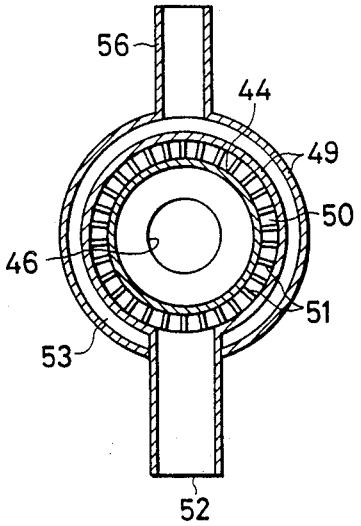
FIG. 10 is a sectional view taken along line X—X in FIG. 8.
Figure 11:
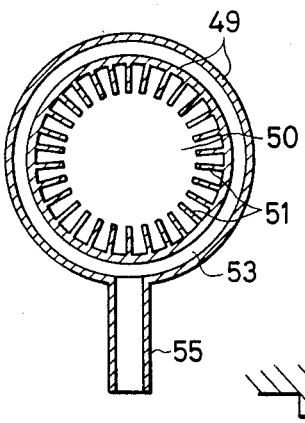
FIG. 11 is a sectional view taken along line XI—XI in FIG. 8.
Figure 12:
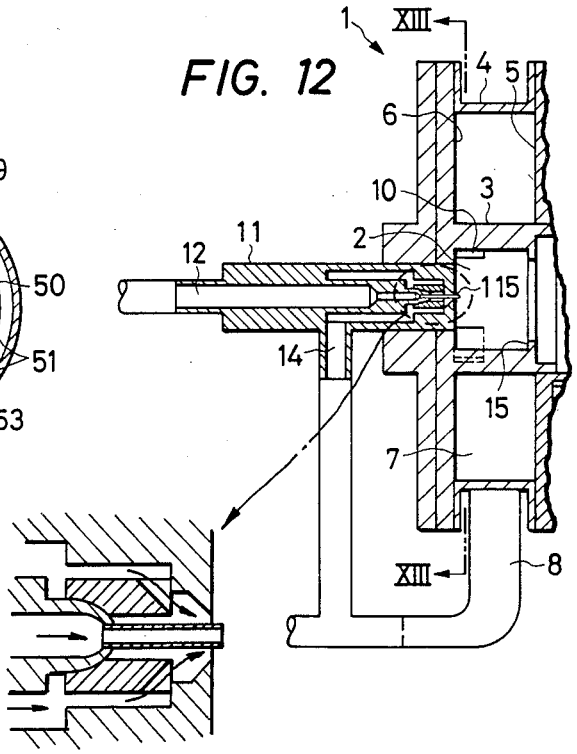
FIG. 12 is a longitudinal sectional side view of a fuel spray combustion device, a third embodiment of the invention.
Figure 13:
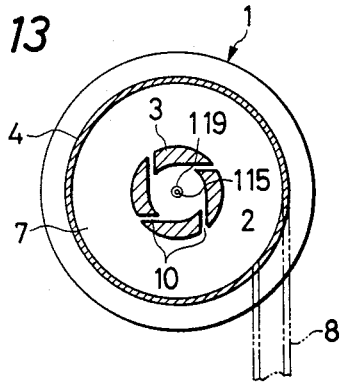
FIG. 13 is a sectional view taken along line XIII—XIII in FIG. 12.

The heat exchanger 48 is designed as shown in FIGS. 8, 10 and 11. A cylindrical container 49 is put on the first and second combustion cylinders 44 and 47 so that a gas passage 50 communicated with the outlet of the second combustion cylinder 47 is formed between the cylindrical container 49 and the first and second combustion cylinders 44 and 47. A number of heat exchanging fins 51 are formed at equal intervals on the inner circumferential surface of the container 49 in such a manner that the fins 51 are provided around the second combustion cylinder 47 and extended towards the central axis of the cylinder 47. The outlet 52 of the gas passage 50 is formed in the portion of the container 49 which is on the side of the first combustion cylinder 44. The cylindrical container 49 is in the form of a dual-container which has a fluid passage 53 in it. A heat exchanging spiral fin 54 is provided on the inner circumferential surface of the fluid passage 53. The fluid passage 53 has an inlet 55 and an outlet 56 at both ends as shown in FIG. 8.

In the fuel spray combustion device of FIG. 8, the second combustion cylinder 47 is smaller in diameter than the first combustion cylinder 44. Therefore, as the combustion flame of the mixture gas flows from the first combustion cylinder 44 through the second choke 46 into the second combustion cylinder 47, the swirling speed and the advancing speed are increased, so that mixing of the fuel and the air is accelerated. The combustion flame, being tapered towards the end, is high in stability. Thus, the combustion is effected satisfactorily.

The fuel injection nozzle 39 is of an ultrasonic oscillation type. Therefore, the droplets of fuel sprayed are considerably small in diameter, i.e., the fuel is atomized satisfactorily. The fuel droplets are considerably small in momentum when formed, and are therefore readily carried away by the swirling air streams, so that the fuel droplets are quickly mixed with the swirling air streams.

As described above, the fuel injection nozzle 39 is protruded into the swirl chamber 32 more than half of the length of the swirl chamber 32. Therefore, the fuel is sprayed into the stable swirling air streams, the mixture gas streams of fuel and air is maintained steady, and the combustion flame is stable. Furthermore, as the air streams swirl around the injection part of the fuel injection nozzle 39, the rise in temperature of the fuel injection nozzle is prevented, and the durability of the electrostrictive elements 42 of the oscillation source is improved.

In the first and second embodiments of the invention, as was described above, (1) The sprayed fuel stream and the swirling air streams are controlled in terms of velocity based on the length and diameter of the combustion cylinders and by providing the chokes to provide combinations of high speed portions and low speed portions. As a result, the mixing of the sprayed fuel stream and the swirling air streams is accelerated at the high speed portion. Further, at the low speed portion the negative pressure region is formed around the central axis so that the stable circulating stream region is provided there. Thus, the combustion flame can be maintained hydrodynamically.

(2) The combustion flame is formed around the central axis of the combustion cylinders and the air layer is formed along the inner walls of the combustion cylinders. Therefore, the rise in temperature rise of the combustion cylinder walls can be suppressed, and the durability of the combustion cylinders is considerably increased.

(3) By contracting the end of the combustion cylinder, the combustion flame is enclosed in the contracted portion, so that the temperature in the combustion chamber is raised. Further, the mixture gas stream is increased in velocity due to the contraction. As a result, the mixing of fuel droplets not burnt and air is promoted, and the fuel sprayed is completely burnt.

(4) The second combustion cylinder is equal to or smaller than the first combustion cylinder in diameter. Therefore the combustion body comprising the first and second combustion cylinders is relatively small in size, and the car heater formed by putting the heat exchanger on the combustion body is also relatively small in size.

(5) As the second combustion cylinder is equal to or smaller than the first combustion cylinder in diameter, the temperature of the wall of the second combustion cylinder is increased, whereby the thermal radiation is increased and the thermal conduction to the heat exchanger is increased; that is, the heat exchange efficiency is increased.

Figure 15:
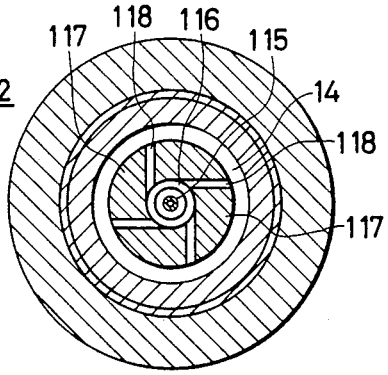
FIG. 15 is a sectional view taken along line XV—XV in FIG. 14.
Figure 16:
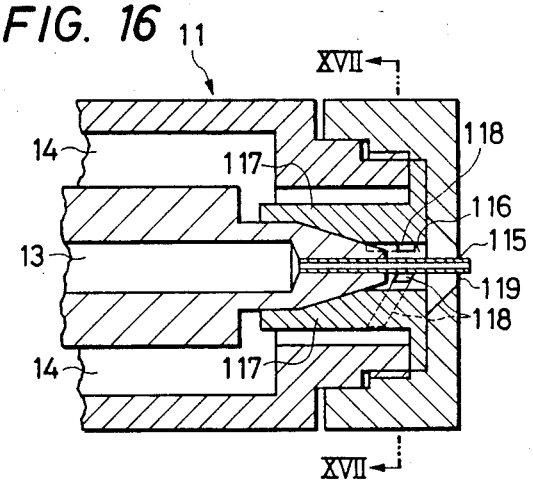
FIG. 16 is an enlarged longitudinal sectional side view of a part of a twin fluid injection unit in a fuel spray combustion device which is a fourth embodiment of the invention.
Figure 17:
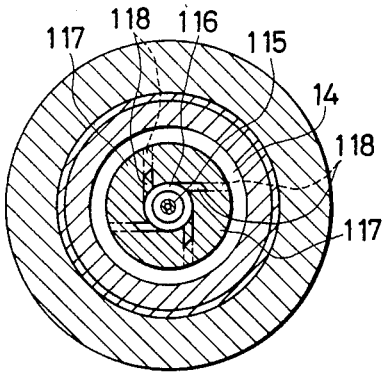
FIG. 17 is a sectional view taken along line XVII—XVII in FIG. 16.

Third Embodiment (cf. FIGS. 12 through 15) and Fourth Embodiment (cf. FIGS. 16 and 17)

Now, third and fourth embodiments of the invention will be described. The third and fourth embodiments, fuel spray combustion devices, have swirl type twin fluid injection units.

The fuel spray combustion device, the third embodiment of the invention, is as shown in FIGS. 12 through 15. In FIGS. 12 through 15, parts corresponding functionally to those already described with reference to the first embodiment are therefore designated by the same reference numerals or characters.

Figure 14:
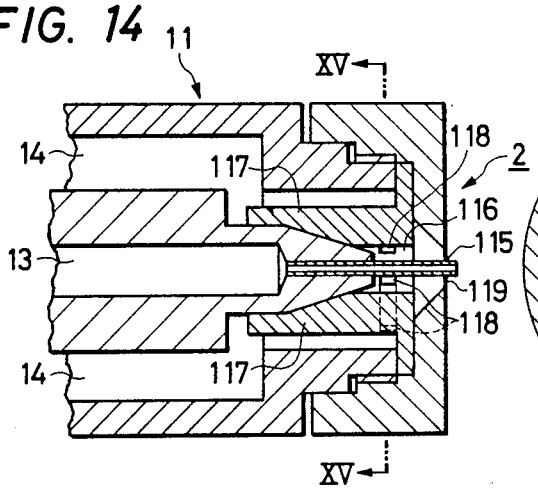
FIG. 14 is an enlarged longitudinal sectional side view showing a part of a twin fluid injection unit in the combustion device shown in FIG. 12.

In the third embodiment, the twin fluid injection unit 11 has its fuel spraying part inserted into the rear end plate 6 of a combustion air stream swirl chamber 2 in such a manner that the injection unit 11 is coaxial with the swirl chamber 2. The twin fluid injection unit is of a twin fluid atomization type such that liquid fuel supplied through a fuel supplying path 12 connected to a fuel supplying source 13 is atomized by an air stream from an air supplying path 14 connected to an air supplying source 9. As shown in FIGS. 14 and 15, the injection unit 11 has a fuel jetting needle 115 which is coupled to the fuel supplying path 13 and extended along the central axis of the unit 11. An atomizing air stream swirl chamber 116 in the form of a cylinder is formed around the needle 115 in such a manner that the chamber 116 is coaxial with the needle 115. Four air intake holes 118 are formed at equal intervals in the circumferential wall 117 of the atomizing air stream swirl chamber 116 at four points in such a manner that the air intake holes 118 are extended along the lines tangent to the four points on the inner surface of the circumferential wall 117 and in the same direction as the air intake holes 10 of the swirl chamber 2. As a result, the air supplying path 14 is communicated with the swirl chamber 116, and the atomizing air stream is introduced to the fuel jetting needle 115 in the atomizing air stream swirl chamber 116 and swirl around the needle 115 in the same direction as the combustion air stream. An orifice 119 is formed in the end of the atomizing air stream swirl chamber 116 in such a manner that it is coaxial with the swirl chamber 116. The orifice 119 has an opening tapered towards the end. The fuel jetting needle 115 has its fuel jetting end inserted into the opening of the orifice 119, so that the liquid fuel jetted from the fuel jetting end of the fuel jetting needle 115 is atomized by the atomizing air stream which is jetted through the opening of the orifice 119 while swirling around the fuel jetting needle 115.

In the above-described twin fluid injection unit 11, the atomizing air stream passing area of the opening of the orifice 119 is eight to forty (8 to 40) times as large as the opening area of the fuel jetting end of the fuel jetting needle 115. In this case, with the minimum flow rate of the atomizing air stream, the fuel can be atomized stably and the combustion flame can be maintained stable.

The diameter of the fuel jetting needle 115 at the fuel jetting end is set to be not more than 0.4 mm. So, even if the flow rate of fuel is as small as 0.01 cc/sec, the fuel can be atomized stably.

The fuel jetting end of the fuel jetting needle 115 is protruded through the surface of an orifice so that the fuel jetting end is positioned in the contraction part of the atomizing air stream jetted from the orifice. This enables the fuel jetted from the fuel jetting end of the fuel jetting needle 115 to be smoothly carried with the atomizing air stream jetted through the orifice 119. Thus, the fuel can be atomized stably and satisfactorily. Furthermore, the sprayed fuel never sticks onto the orifice and it is never carbonized.

As described above, in the twin fluid injection unit 11 of the third embodiment of the invention, the air intake holes 118 are formed in the circumferential wall 117 of the atomizing air stream swirl chamber 116 at several points in such a manner that the holes 118 are extended along the lines tangent to the points on the inner surface of the circumferential wall 117. And the holes 118 are in parallel with the diameter directions of the atomizing air stream swirl chamber 116 as shown in FIGS. 14 and 15. However, the air intake holes may be extended in such a manner that they form an angle with the diameter directions as in the fourth embodiment of the invention shown in FIGS. 16 and 17.

In the fourth embodiment, as shown in FIGS. 16 and 17, a fuel jetting needle 115 is coaxially connected to the fuel supplying path 12. A cylinder-shaped swirl chamber 116 is formed around the fuel jetting needle 115 in such a manner that the swirl chamber 116 is coaxial with the needle 115. Air intake holes 118 are formed at equal intervals in a circumferential wall 117 at four points which is provided between the swirl chamber 116 and an air supplying path 14 in such a manner that the holes 118 are extended along the lines tangent to the points on the inner surface of the circumferential wall and in the same directions as the air intake holes 10 in the combustion air stream swirl chamber 2. That is, the air intake holes 118 form 60° angles with the fuel jetting needle 115. As a result, the air supplying path 14 is communicated through the four air intake holes 118 with the swirl chamber 116, and the atomizing air streams are introduced into the swirl chamber 116 which flows in the fuel jetting direction of the fuel jetting needle 115 while swirling around the fuel jetting needle 115 in the same directions as the combustion air stream.

As shown in FIG. 16, an orifice 119 is formed in the front end of the swirl chamber 116 in such a manner that the orifice is coaxial with the swirl chamber. The orifice 119 has an opening tapered towards the end. The fuel jetting end of the fuel jetting needle 115 is inserted into the tapered opening so that the liquid fuel jetted from the fuel jetting end of the fuel jetting needle 115 is atomized by the atomizing air stream jetted through the opening of the orifice 119 while swirling around the fuel jetting needle 115.

In the above-described third and fourth embodiments of the invention, (1) As the liquid fuel is atomized by the swirling air stream, the fuel spraying angle is large. Therefore, the droplets of fuel sprayed are sufficiently scattered, and readily mixed with the combustion air.

(2) As the droplets of fuel atomized have a peripheral speed component in the swirl direction, the axial direction (fuel jetting direction) speed component is decreased as much, and therefore the locus of flying is substantially lengthened, which provides a period of time necessary for evaporation and combustion of the atomized fuel. Thus, the complete fuel combustion is achieved.

(3) The combustion flame is maintained by the circulation stream which is formed around the axis by the swirling eddy and the stepwise expansion. When the sprayed fuel stream is swirled in the same direction as the circulation stream, the circulation stream around the axis is spread near to the injection nozzle, so that the combustion flame is further increased in stability. Therefore, even if the length of the combustion flame is decreased by reducing the flow rate of fuel supplied, the combustion flame will never be blown off or oscillated.

(4) Stable atomization of the fuel greatly affects the stability of the combustion flame. For instance in the case where the flow rate of fuel is extremely small, not more than 0.1 g/s, the diameter of the fuel jetting outlet must be 0.4 mm or less. If it is larger than 0.4 mm, then the fuel is intermittently atomized; that is, the fuel injection valve cannot be used.

(5) In general, a twin fluid atomization is defined by a mass flow ratio (or volume flow ratio) of atomizing fluid and fluid to be atomized and by a relative velocity difference therebetween. Therefore, when fluid (fuel) to be atomized is given, it is necessary to increase the pressure of atomizing fluid (air) to obtain a sufficient flow ratio and velocity difference. In this case, it is essential to minimize the loss of pressure and to efficiently atomize the fluid with small energy. This requirement can be satisfied in case that the atomizing air stream passing area of the opening of the orifice 119 is eight to forty times as large as the opening area of the fuel jetting end of the fuel jetting needle 115.

For instance in the case where the atomizing air pressure is 0.1 $Kg/cm^2$ and the fuel flow rate is 0.05 g/s, the droplets of fuel sprayed are about 45 $\mu m$ in Sauter mean diameter.

(6) As the fuel jetting needle is protruded through the orifice into the contracted part of the atomizing air stream, the fuel is atomized in the region of the atomizing air stream which is highest in velocity and in stability. Therefore, the atomization is effected with highest efficiency, and the droplets of fuel are stably formed.

In the third and fourth embodiments, the sprayed fuel stream is carried away by the swirling air stream, and therefore it will never stick onto the surface of the orifice. Accordingly, no carbon is deposited when the sprayed fuel is burnt.

Figure 18:
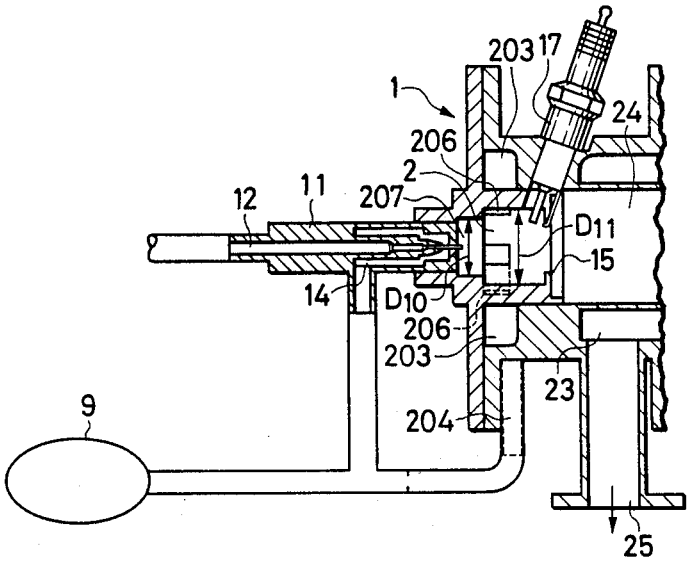
FIG. 18 is a longitudinal sectional side view showing a part of a fuel spray combustion device which is a fifth embodiment of the invention.
Figure 19:
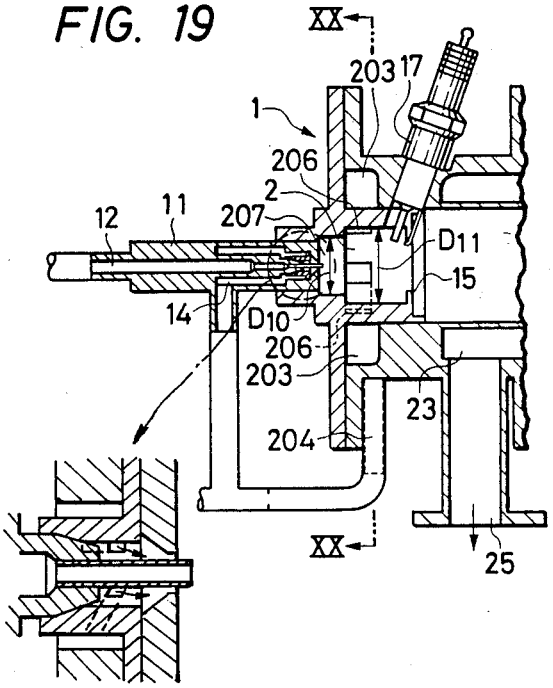
FIG. 19 is a longitudinal sectional side view showing a part of a fuel spray combustion device, a sixth embodiment of the invention.
Figure 20:
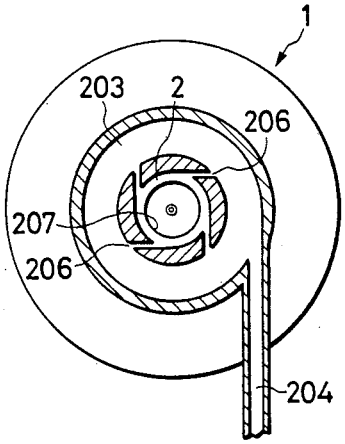
FIG. 20 is a sectional view taken along line XX—XX in FIG. 19.

Fifth Embodiment (cf. FIG. 18) and Sixth Embodiment (cf. FIGS. 19 and 20)

Fifth and sixth embodiments of the invention, fuel spray combustion devices, will be described.

The fifth and sixth embodiments of the invention, as shown in FIGS. 18 and 19, has a swirl unit 1. In the swirl unit 1, an annular air swirl path 203 is formed around a swirl chamber 2 in such a manner that the air swirl path 203 is coaxial with the swirl chamber 2. An air intake pipe 204 is connected to the outer circumferential wall of the air swirl path 203 at one point in such a manner that the air intake pipe 204 is extended along the line tangent to the point on the outer circumferential wall and communicated with the air swirl path 203. The air intake path 204 is connected to an air supplying source 9. Four air intake holes 206 are formed at equal intervals in a circumferential wall at four points which is provided between the air swirl path 203 and the swirl chamber 2 in such a manner that the air intake holes 206 are extended along the lines tangent to the four points on the inner surface of the circumferential wall and the air swirl path 203 is communicated with the swirl chamber 2 through the air intake holes 206. Therefore, the combustion air streams are introduced into the swirl chamber 2 which swirl around the central axis of the swirl chamber 2.

The fifth embodiment of the invention further comprises an atomizing chamber 207, in addition to a twin fluid injection unit 11, a first choke 15, a first combustion cylinder 16, a second choke 19, and a second combustion cylinder similar to those of the first embodiment. The diameter $D_{10}$ of the atomizing chamber 207 is smaller than that $D_{11}$ of the swirl chamber 2. An ignition unit 17 is protruded into the swirl chamber 2.

In the fifth embodiment of the invention, (1) The stream of fuel atomized by the high-velocity air stream is introduced into the swirl chamber after its velocity has been decreased in the atomizing chamber, so that the atomized fuel stream is mixed with the air stream in the swirl chamber. Therefore, the atomized fuel stream and the air stream are mixed uniformly. The mixture gas can be positively ignited in the swirl chamber by spark ignition.

(2) As the atomized fuel and the air stream are sufficiently mixed in the swirl chamber, no carbon or the like is deposited on the end portion of the ignition plug.

(3) As the atomized fuel is mixed with the swirling air stream after being decelerated, the circulation region formed around the central axis of the swirl chamber is stable, and therefore the combustion is effected with low noise.

On the other hand, the sixth embodiment of the invention comprises, in addition to the above-described swirl chamber 2 and atomizing chamber 207, the swirling twin fluid injection unit, first choke, first combustion cylinder, second choke and second combustion cylinder which have been described with reference to the third and fourth embodiments. The diameter $D_{10}$ of the atomizing chamber 207 is smaller that the diameter $D_{11}$ of the swirl chamber 2.

In the sixth embodiment of the invention, (1) The swirling atomized fuel stream forms the first eddy in the atomizing chamber. The eddy is introduced into the swirl chamber, thus being stepwise expanded. In the swirl chamber, the second eddy is formed by the combustion air stream. The second eddy is led into the combustion cylinder, thus being stepwise expanded again. The formation of the eddies and the abrupt expansion of the piping contribute, in combination, to form the stable wide circulation region around the central axis of the combustion cylinder. Therefore, in the case where the combustion intensity is high, a high fuel density region and a low fuel density region are provided by the first and second eddies, respectively, and therefore the combustion temperature can be maintained uniform.

(2) Even when the combustion intensity becomes low and the length of the combustion flame becomes short, the flame can be maintained only by the first eddy; that is, combustion flame will be maintained until the flow rate of fuel has decreased to a small value, 0.01 g/s. The range of fuel flow rates in which the combustion is maintained stable is sufficiently wide.

(3) In the case of the atomizing fluid stream having a velocity component in a circumferential direction and a velocity component in an axial direction, the loss of pressure of the atomizing fluid can be decreased. Furthermore, the atomized fuel stream has a suitable velocity component in the axial direction, which accelerates the mixing of the atomized fuel stream and the combustion air stream.

Obviously, numerous modifications and variations of the present invention are possible in light of the above teachings. It is therefore to be understood that within the scope of the appended claims, the invention may be practiced otherwise than as specifically described herein.

What is claimed is:

1. A fuel spray combustion device comprising:

a cylinder-shaped swirl chamber having air intake means through which combustion air streams are introduced into said swirl chamber to swirl around a central axis of said swirl chamber;

fuel injection means provided coaxially with said swirl chamber, for spraying fuel from a first end of said swirl chamber towards a second end of said swirl chamber;

an ignition plug provided in a region where the fuel is sprayed from said fuel injection means;

a first combustion cylinder connected through a first stepwise choke to the second end of said swirl chamber in such a manner that said first combustion cylinder is coaxial with said swirl chamber, said first combustion cylinder having uninterrupted circumferential walls and being larger than or equal to said swirl chamber in diameter, said first combustion cylinder allowing the mixture of said swirled air streams and said fuel passes through said first stepwise choke to be burnt into a flame in the center portion thereof and allowing said swirled air streams between said mixture and said first stepwise choke to flow along the wall thereof; and a second combustion cylinder connected through a second stepwise choke to the outlet of said first combustion cylinder in such a manner that said second combustion cylinder is coaxial with said first combustion cylinder, said second combustion cylinder being smaller than or equal to said first combustion cylinder in diameter and allowing said flame passed through said second stepwise choke to be mixed with said air streams flowing along the wall of said first combustion cylinder to promote combustion.

2. A fuel spray combustion device as claimed in claim 1, wherein the diameter of said choke provided between said swirl chamber and said first combustion cylinder is not less than 0.6 times as large as the diameter of said swirl chamber, and the diameter of said first combustion cylinder is not more than twice as large as the diameter of said swirl chamber.

3. A fuel spray combustion device as claimed in claim 1, wherein the length of said swirl chamber is not less than 0.5 times as large as the diameter of said swirl chamber and not more than 1.5 times as large as the diameter of said swirl chamber.

4. A fuel spray combustion device as claimed in claim 1, wherein the diameter of said second choke provided between said first and second combustion cylinder is not less than 0.5 times and not more than 0.8 times as large as the diameter of said first combustion cylinder.

5. A fuel spray combustion device as claimed in claim 1, wherein the diameter of said second combustion cylinder is not less than 0.6 times as large as the diameter of said first combustion cylinder.

6. A fuel spray combustion device as claimed in claim 1, wherein said fuel injection means is of a plain-jet air blast atomization type for atomizing fuel by use of atomization air streams. 6. A fuel spray combustion device as claimed in claim 1, wherein said fuel injection means is of a plain-jet air blast atomization type for atomizing fuel by use of atomization air streams.

7. A fuel spray combustion device as claimed in claim 6, further comprising cylinder-shaped air stream swirling means for providing atomization air streams which swirl in the same direction as said combustion air streams, wherein said fuel injection means comprises a fuel jetting needle for supplying the fuel through a fuel jetting end thereof and an orifice formed at an end of said air stream swirling means, said fuel jetting end of said fuel jetting needle being inserted into said orifice so that said atomization air streams are swirled around said fuel jetting needle and jetted through said orifice, thereby atomizing the fuel jetted from the fuel jetting end of said fuel jetting needle by means of said atomization air streams.

8. A fuel spray combustion device as claimed in claim 7, wherein the opening area of said orifice for passing said atomization air streams is not less than eight times and not more than forty times as large as the opening area of the fuel jetting end of said fuel jetting needle.

9. A fuel spray combustion device as claimed in claim 7, wherein the opening diameter of the fuel jetting end of said fuel jetting needle is not more than 0.4 mm.

10. A fuel spray combustion device as claimed in claim 1, wherein the opening diameter of the fuel jetting end of said fuel jetting needle is not more than 0.4 mm.

11. A fuel spray combustion device as claimed in claim 6, further comprising an atomizing chamber provided between said fuel injection means and said swirl chamber, thereby atomizing the fuel in said atomizing chamber with atomization air streams and injecting the atomized fuel towards said swirl chamber.

12. A fuel spray combustion device as claimed in claim 11, further comprising cylinder-shaped air stream swirling means for providing atomization air streams which swirl in the same direction as said combustion air streams, wherein said atomizing chamber is smaller in diameter than said swirl chamber and is coaxial with said swirl chamber.

13. A fuel spray combustion device as claimed in claim 12, wherein said fuel injection means is of a type in which atomization air streams have peripheral speed component in the swirl direction and an axial speed component in the fuel injection direction.

14. A fuel spray combustion device as claimed in claim 1, wherein said fuel injection means comprises an ultrasonic oscillation atomizer for atomizing fuel by ultrasonic oscillation, said atomizer being protruded into said swirl chamber not less than 0.5 times as long as the length of said swirl chamber.

15. A fuel spray combustion device comprising:

a cylinder-shaped swirl chamber having air intake means through which combustion air streams are introduced into said swirl chamber to swirl around a central axis of said swirl chamber;

fuel injection means provided coaxially with said swirl chamber, comprising a fuel jetting needle for spraying fuel from a first end of said swirl chamber towards a second end of said swirl chamber, and an orifice for jetting high-speed atomization air streams in order to atomize said fuel sprayed from said fuel jetting needle, said fuel jetting needle protruded through said orifice so that the fuel jetting end thereof is positioned in a contracted stream portion of said atomization air streams jetted from said orifice;

an ignition plug provided in a region where the fuel is sprayed from said fuel injection means;

a first combustion cylinder connected through a first stepwise choke to the second end of said swirl chamber in such a manner that said first combustion cylinder is coaxial with said swirl chamber, said first combustion cylinder having uninterrupted circumferential walls and being larger than or equal to said swirl chamber in diameter, said first combustion cylinder allowing the mixture of said swirled air streams and said fuel passed through said first stepwise choke to be burnt into a flame in the central portion thereof and allowing said swirled air streams between said mixture and said first stepwise choke to flow along the wall thereof; and a second combustion cylinder connected through a second stepwise choke to the outlet of said first combustion cylinder in such a manner that said second combustion cylinder is coaxial with said first combustion cylinder, said second combustion cylinder being smaller than or equal to said first combustion cylinder in diameter and allowing said flame passed through said second stepwise choke to be mixed with said air streams flowing along the wall of said first combustion cylinder to promote combustion.

* * * * *